US006622639B2

(12) United States Patent
Marcel

(10) Patent No.: US 6,622,639 B2
(45) Date of Patent: Sep. 23, 2003

(54) PALLET FOR UPRIGHT TRANSPORTING OF A LOADER BOOM AND TRANSPORT METHOD

(75) Inventor: Alain Marcel, Velet (FR)

(73) Assignee: Deere & Company, Moline, IL (US)

( * ) Notice: Subject to any disclaimer, the term of this patent is extended or adjusted under 35 U.S.C. 154(b) by 34 days.

(21) Appl. No.: 09/829,243

(22) Filed: Apr. 9, 2001

(65) Prior Publication Data

US 2001/0033789 A1 Oct. 25, 2001

(30) Foreign Application Priority Data

Apr. 12, 2000 (DE) ..... 100 18 113

(51) Int. Cl.[7] ..... B65D 19/00
(52) U.S. Cl. ..... 108/51.11; 108/54.1; 108/56.1
(58) Field of Search ..... 118/51.11, 54.1, 118/56.1, 57, 32

(56) References Cited

U.S. PATENT DOCUMENTS 5,267,516 A * 12/1993 Abrahamson et al.
5,626,231 A * 5/1997 Kwong et al.
5,870,958 A * 2/1999 Suzuki
6,003,449 A * 12/1999 Manidis

FOREIGN PATENT DOCUMENTS

EP 513786 A2 * 11/1992

* cited by examiner

*Primary Examiner*—Jose V. Chen

(57) ABSTRACT

A pallet for carrying a boom of a front-end loader is constructed with spaces at one end so for receiving the corresponding end of an identical pallet, whereby the two pallets may be secured together to form a unit. When front loader booms of a type including a pair of transversely spaced arms are mounted in an upright disposition on the unitized pair of pallets, the booms overlap such that one arm of one is located between the spaced arms of the other. The dimensions of the unitized pallet are such that its length approximates the width of a standard sea-going container while its width is approximately a whole number fraction of the standard container length.

2 Claims, 3 Drawing Sheets

PALLET FOR UPRIGHT TRANSPORTING OF A LOADER BOOM AND TRANSPORT METHOD

FIELD OF THE INVENTION

The invention pertains to a pallet for upright transporting of a hoisting device, in particular a front-end loader.

BACKGROUND OF THE INVENTION

It is already known how to mount a front loader upright on an existing and standardized wooden pallet, where the front loader, when in the mounted position, does not extend out beyond the side edges of the wooden pallet. The various accessories, such as the bucket, control devices and the like are deposited in the open space between the arms of the front loader boom. This already proven transport method does not allow a space-saving shipping of many front loaders, e.g., in a sea-going container.

In order to achieve a greater load density, according to another method, several front loaders are placed prone, one upon the other, on one wooden pallet. The dimensions of length and of width of the front loaders located on the pallet are configured so that the load surface of a sea-going container cannot be utilized to the optimum. In addition, there is danger of paint damage to the front loaders stacked one upon the other, and the front loaders must be separated from each other during unloading so that they can be provided to the end users.

The problem underlying the invention can be described in that with the known methods and pallets, an optimum filling of standard sea-going containers is not possible.

SUMMARY OF THE INVENTION

According to the present invention there is provided an improved pallet for supporting devices for being shipped in sea-going containers.

An object of the invention is to provide a pallet having supports constructed so as to define gaps along one side into which supports of a like pallet may be inserted to form a compact arrangement with the first pallet.

Another object is to provide a pallet, as set forth in the preceding object, for supporting a front-end loader boom having spaced arms, in a standing disposition.

Yet another object is to provide a pallet, as set forth in the immediately preceding object, wherein a pair of like loaded pallets may be slid together with one spaced arm of the loader on one of the pallets being disposed between the spaced arms of the loader on the other of the pallets.

Another object of the invention is to provide a pair of loaded pallets, as set forth in the immediately preceding object, wherein the pair of pallets may be secured to each other and when so secured have a length dimension approximately equal to the width dimension of a standard sea-going shipping container, and to have a width dimension which is approximately a whole number fraction of a length dimension of the shipping container.

These and other objects will become apparent from a reading of the ensuing description together with the appended drawings.

DESCRIPTION OF THE PREFERRED EMBODIMENT

Figure 1:
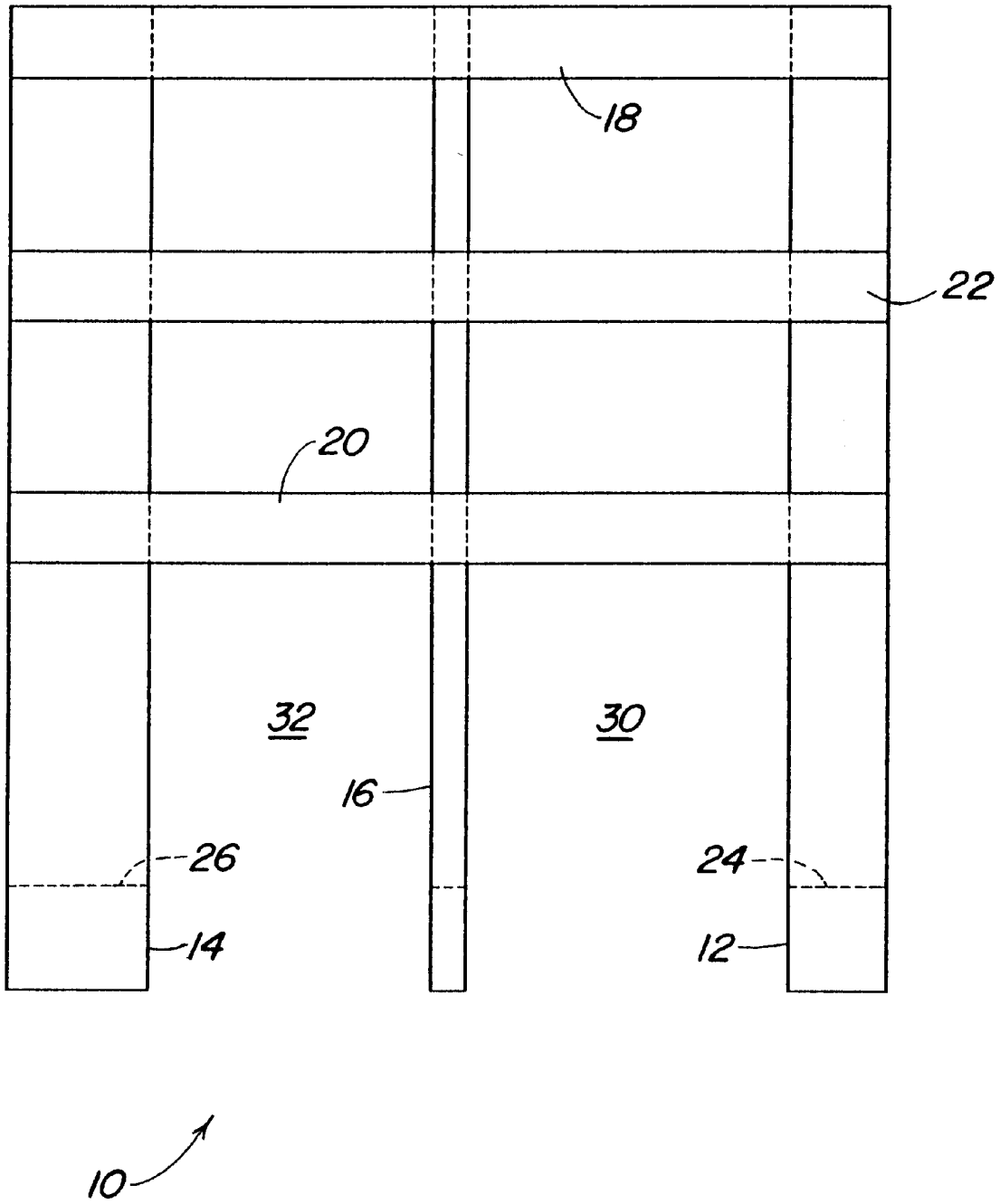
FIG. 1 is a top plan view of a pallet constructed in accordance with the present invention.

Referring now to FIG. 1, there is shown a pallet 10 comprising parallel, right-hand, left-hand and intermediate beams 12, 14 and 16, respectively, joined together by three parallel, upper cross members 18, 20 and 22, respectively, and two lower cross members 18' and 20', respectively, located below the beams in at least partial vertical alignment with the cross members 18 and 20. The cross members 18–18', 20–20' and 22 are each disposed at right angles to the beams and are of a length equal to the distance between opposite outer sides of the right-and left-hand beams 12 and 14. The upper cross members 18, 20 and 22 are here shown as being identical, with cross member 18 being located across one end region of each of the beams 12, 14 and 16, with cross member 20 being located approximately half way between opposite ends of the beams, and with cross member 22 being located between the cross members 18 and 20. The lower cross members 18' and 20' are approximately three times thicker than the upper cross members 18 and 20 which establishes plenty of space for the insertion of the forks of a forklift truck beneath the beams. Aiding in supporting the beams 12, 14 and 16 above the ground are right-hand, left-hand and intermediate blocks 24, 26 and 28, respectively, that are located under those end regions of the beams 12, 14, and 16 that are spaced beyond the cross members 20 and 20'. The ends of the beams 12, 14 and 16 that extend beyond the cross member 22 are not interconnected and thus are in the form of fork tines that define gaps or spaces 30 and 32, respectively, between the middle bean 16 and the right- and left-hand beams 12 and 14.

The open spaces 30 and 32 are at least as wide as one beam 12 or 14. Even though fundamentally it is sufficient to create only one open space 30 or 32, preferably both are created. According to the representation in FIGS. 1 and 2, the intermediate beam 16 is located along a central line of the pallet 10 with the spaces 30 and 32 being located at opposite sides of the beam 16. However, if necessary; the beam 16 may be positioned asymmetrical to a center line of the pallet 10 in order to achieve a different connection when connecting two pallets 10 together as described below.

Figure 2:
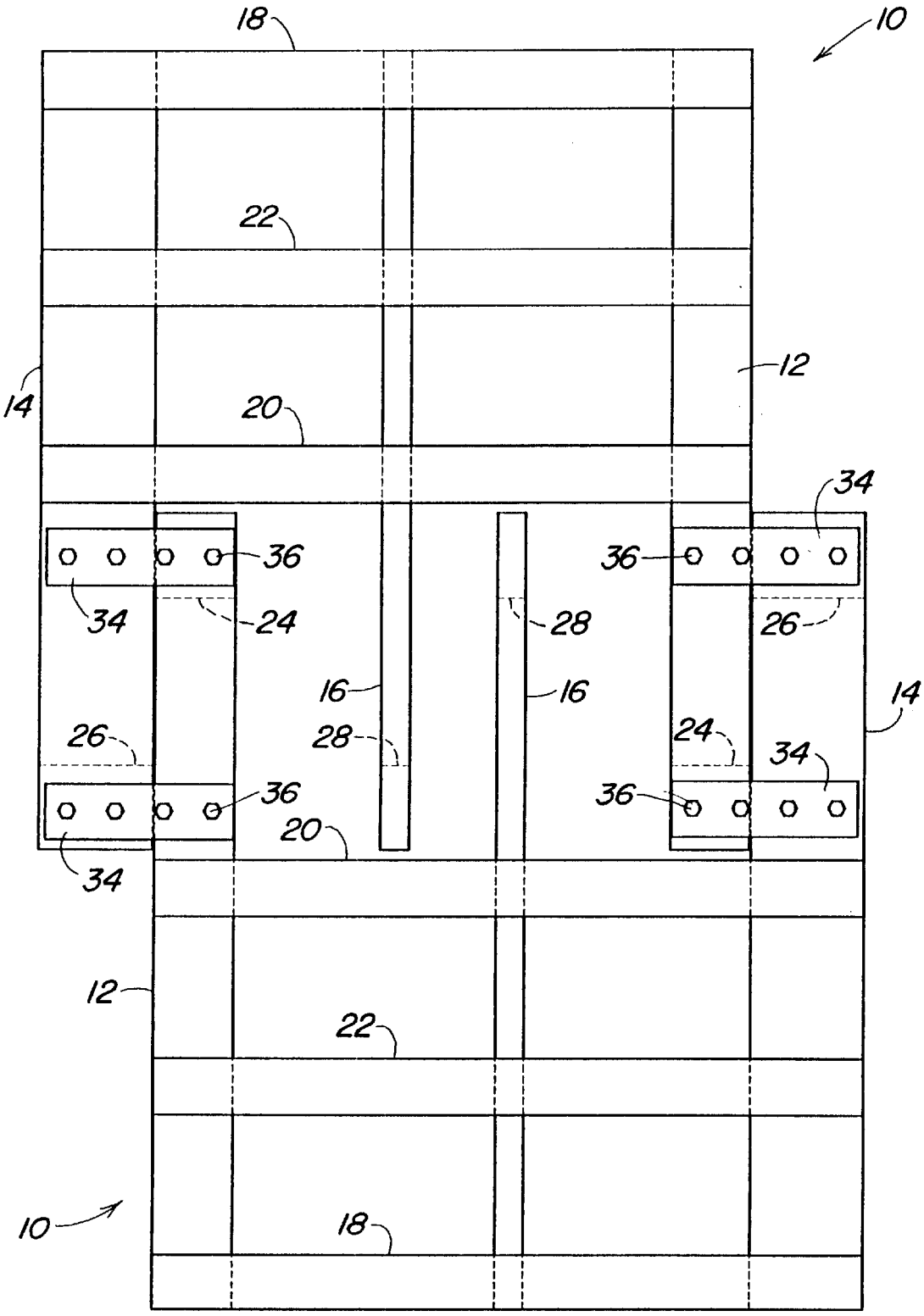
FIG. 2 is a top plan view of a pair of pallets, like that shown in FIG. 1, which are moved into overlapping positions and joined together.

Referring now to FIG. 2, first and second pallets 10 are shown with their forked ends facing each other, with the beams 12 and 14 of one pallet being located respectively along inner and outer sides of the other pallet 10. Four identical straps 34 are shown with a first pair respectively connecting the end regions of the beams 12 and 14 of the first pallet to the beams 12 and 14 of the second pallet; and with a second pair of straps 34 respectively connecting the end regions of the beams 12 and 14 of the second pallet to the beams 14 and 16 of the first pallet. In another design format (not shown) only one strap 34 could be used which would span across the entire width of both pallets 10, and thus across the beams 14 and 16 of both pallets as well as the spaces 30 and 32. In any case, the straps 34 are made of steel band or from a steel strip and have openings (not visible) to receive attachment elements 36, e.g., wood screws.

Figure 3:
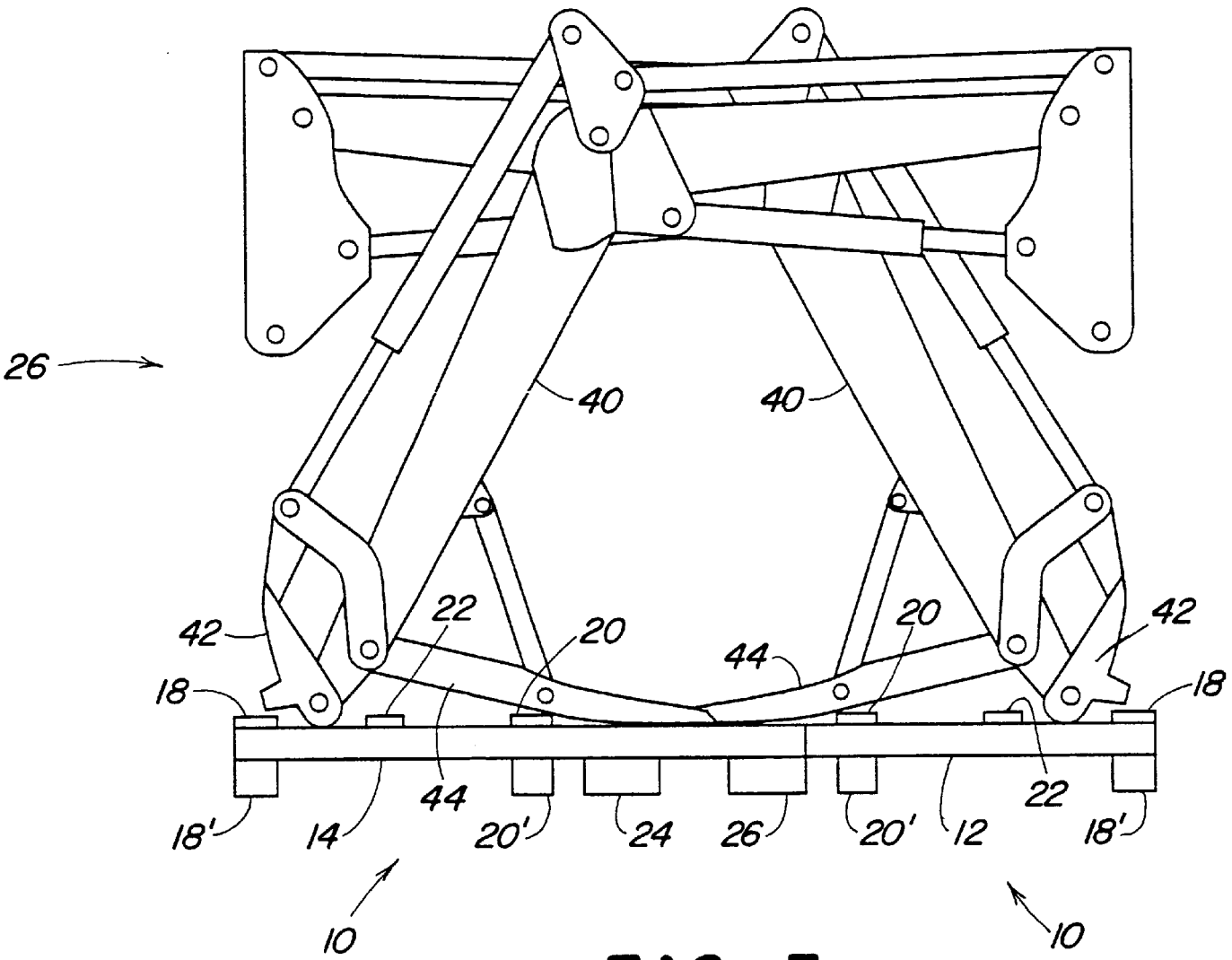
FIG. 3 is a side view showing front loader booms respectively mounted in upright dispositions on the joined pair of pallets.

Referring now to FIG. 3, there is shown a pair of pallets 10 on which are respectively mounted a pair of loaders 38.

The loaders 38 are of a known design including a boom constructed from a pair of parallel, transversely spaced arms 40, that are angled between rear and front ends, as considered when the loader is in use, so as to define an intermediate knee section. The forward ends of the pair of arms 40 have an implement or tool carrier 42 mounted thereto, and mounted to at least one, but usually to each, of the arms 40 at a region near the carrier 42 is a parking stand or brace 44.

The arms 40 are spaced apart a distance sufficient for permitting one arm 40 of one loader 38 to be placed between the arms 40 of the other loader 38. Thus, as viewed in FIG. 3, the tool carrier 42 of one loader 38 is placed at the left top end region of the left-hand pallet 10, while the tool carrier 42 of the other loader 38 is similarly placed at the right top end region of the right-hand pallet 10. The parking stands 44 respectively of the two loaders 38 extend toward each other to the middle of the combined pallets 10. The tool carriers 42 of the respective loaders 38 are located at opposite side regions of the combined pallets 10 and cooperate with the respective parking stands 44 to support the boom arms 40 at an inclination which ensures that the arms 40 and the tool carrier 42 do not extend out beyond the opposite sides of the two joined pallets 10. Also, together with the pallets 10 the arms 40 do not exceed a height which corresponds to the inside loading space of a sea-going container or other container, such as a railroad boxcar, for example. A standard exterior dimension for such a container is 40' (≈12.2 m) long×8'(≈2.44 m) wide×8'(≈2.44 m) high. A suitable joined, two pallet unit has the dimensions of 2180 mm long×1560 mm wide, with the unit fitting lengthwise across the width of the interior of the container with a small clearance at each end, with eight units fitting within the length of the container interior with a small clearance left.

The tool carrier 42 rests upon and may be releasably secured to the associated pallet 10 by angle irons, wire, screws, clamps, or the like. To increase the structural integrity, in the preferred design example, the parking stands 44 are likewise respectively tightly secured, e.g., screwed, nailed or wire-tied to the linked pallets 10.

Accordingly, the following method for loading of the front end loaders 10 can be accomplished. Initially, one loader 38 is set upon one of the pallets 10 in the manner shown in FIG. 3 by means of a crane or similar machine, so that the tool carrier 42 rests on one end region of the pallet 10. Next the parking stand or stands 44 are folded down and secured to the pallet 10. Next, the tool carrier 42 is likewise secured to the pallet 10, so that the loader 38 forms a unit with the pallet 10. In this situation, one of the pair of arms 40 will be located upon or over one of the beams 12 or 14, whereas the open spaces 30 and 32 are located between the loader arms 40. In this state, the pallet 10 can be transported with the loader 38 by using a forklift or similar machinery wherein the forks project crosswise beneath the beams of the pallet.

For an optimum loading and unloading of several loaders 38 mounted upon respective pallets 10, two loaded pallets 10 can be joined together in the manner shown in FIG. 2, i.e., they are positioned at an offset to each other and as mirror images (disregarding the fact that the beams 12 and 14 are different sizes) with respect to each other. In this manner, the beams 12 or 14 of the one pallet 10 are moved into the open space 30 or 32 of the other pallet 10, whereas the arms 40 of the two involved loaders 38 overlap each other with one arm of one loader being between the two arms of the other loader. Finally, the straps 34 are set down in the region between the two loaders upon the two pallets and are fixed by using the attachment elements 36. Consequently, a unit is formed composed of two pallets 10 and two loaders 38, which can be jointly handled and which require the smallest possible amount of space.

In a slightly revised version, the pair of pallets 10 to be linked could be oriented in the same direction with the exposed ends of the beams 12, 14, and 16 of one pallet inserted into the gaps between the center beam 16 and the beams 12 and 14 of the other pallet.

Accessories of the loaders 38 can be placed in the remaining free spaces at the top of the pallets 10

Having described the preferred embodiment, it will become apparent that various modifications can be made without departing from the scope of the invention as defined in the accompanying claims.

What is claimed is:

1. In a pallet assembly including first and second identical pallets, wherein each pallet includes at least first and second parallel beams defining opposite sides thereof, a plurality of pairs of upper and lower cross members being disposed at right angles to and respectively fixed to upper and lower surfaces of said beams, the improvement comprising: each pallet being constructed such that none of said upper and lower cross members are closer than approximately half the length of said beams from respective first end regions of said beams to thereby define an open space between said beams; and said second pallet being disposed with approximately half the length of said at least first and second beams thereof respectively placed alongside approximately half the length of said at least first and second beams of said first pallet; and a connecting arrangement establishing a releasable connection between the beams of said first and second pallets to thereby form an integral unit.

2. The pallet as defined in claim 1 wherein said first and second pallets, when connected together, have a length dimension which is essentially equal to 2180 mm and a width dimension which is essentially equal to 1560 mm, whereby eight joined pallets may be placed in a standard shipping container having a length of 12.2 m and a width of 2.44 m.

* * * * *